US008551260B2

(12) United States Patent
Horriat et al.

(10) Patent No.: US 8,551,260 B2
(45) Date of Patent: Oct. 8, 2013

(54) FUEL INJECTION FLUSH TOOL

(76) Inventors: Parviz R. Horriat, Mission Viejo, CA (US); Jimmy B. Horriat, Mission Viejo, CA (US)

( * ) Notice: Subject to any disclaimer, the term of this patent is extended or adjusted under 35 U.S.C. 154(b) by 847 days.

(21) Appl. No.: 12/661,617

(22) Filed: Mar. 22, 2010

(65) Prior Publication Data

US 2011/0226213 A1 Sep. 22, 2011

(51) Int. Cl.
*B08B 3/04* (2006.01)

(52) U.S. Cl.
USPC ..... 134/22.1; 134/21; 134/22.12; 134/22.18; 134/23; 134/39

(58) Field of Classification Search
None
See application file for complete search history.

(56) References Cited

U.S. PATENT DOCUMENTS 4,909,207 A * 3/1990 Takano et al. ..... 123/198 A
5,257,604 A * 11/1993 Vataru et al. ..... 123/198 A

* cited by examiner

*Primary Examiner* — Michael Kornakov
*Assistant Examiner* — Ryan Coleman
(74) *Attorney, Agent, or Firm* — Morland C. Fischer

(57) ABSTRACT

A fuel injection flush tool adapted to be connected to a conventional fuel injection flush canister in which a supply of combustible liquid fuel injection cleaner is stored. Liquid cleaner is delivered from the flush canister to a gasoline or diesel-driven engine being serviced by which to burn off carbon deposits from the fuel injectors and related parts during a tune-up or service. During one embodiment, air is applied to the flush canister so that the liquid cleaner is delivered from the canister at a pressure which corresponds to the operating pressure of the engine running at idle. In this case, the fuel injectors can advantageously be cleaned (i.e., decarbonized) in a relatively short time and at reduced cost without having to turn off the engine, disable the fuel pump, or remove seats, fuses, relays, etc.

13 Claims, 6 Drawing Sheets

7
12
10
5
AIR
9
3
1
16
CK V
28
14
18
22
26
32
CK V
24
34
TO INJECTORS FUEL SUPPLY INLET
15
30
20
FROM FUEL PUMP/ GAS TANK
RETURN TO GAS TANK 7
12
10
3
AIR
9
5
FUEL
INJECTOR
CLEANER
1
16
CK
V
28
14
18
32
22
26
CK
V
24
20
FUEL LINE
15
FROM
FUEL PUMP/
GAS TANK
40
30
36
36
36
RETURN TO
GAS TANK
35
36

FUEL INJECTION FLUSH TOOL

BACKGROUND OF THE INVENTION

1. Field of the Invention

This invention relates to a fuel injection flush tool adapted to be detachably connected to a conventional fuel injection flush canister from which a supply of combustible liquid fuel injection cleaner can be delivered for efficiently cleaning the fuel injectors of the engines of both gasoline and diesel-driven motor vehicles at relatively low cost, in a relatively short time and without having to disable the fuel pump.

2. Background Art

Motor vehicles need to be serviced from time-to-time, for example, to eliminate the buildup of carbon deposits which can cause the engine of the vehicle to run poorly and inefficiently. It is known to use a combustible liquid chemical cleaner to decarbonize the engine. That is to say, a liquid cleaner is supplied under pressure from a flush canister to remove carbon from the cylinders, fuel rails, pistons, intake valves, etc. of the engine. In many cases, tuning up the engines of most modern vehicles consists primarily of the aforementioned decarbonization process.

To initiate such a process, the engine of the vehicle being serviced must be running at operating temperature. The technician has to either refer to the vehicle's technical operating manual or guess the fuel pump pressure at which the liquid cleaner will be delivered to the engine to remove the carbon deposits therefrom. What is more, the fuel lines must first be disconnected and the electric fuel pump turned off. Similarly, the fuel pump fuse or relay should be disconnected from the fuel pump circuit. In some cases, it may be necessary for the technician to drop the fuel tank or remove the seats. These preliminary actions and disconnections required prior to starting the decarbonization process are frequently difficult and time consuming to accurately and fully achieve. Consequently, the cost to complete an engine tune-up may be correspondingly increased.

Therefore, what is needed is an efficient, low cost and easy-to-use tool by which a cleaning fluid can be delivered, under OEM fuel specification pressure, from a flush canister to the fuel injectors of a motor vehicle engine to remove carbon deposits therefrom.

SUMMARY OF THE INVENTION

In general terms, fuel injection flush tools are disclosed which are detachably connected to a conventional fuel injection flush canister so that a supply of combustible liquid fuel injection cleaner can be delivered, under pressure, to clean the fuel injectors of a gasoline or diesel-driven motor vehicle. By virtue of the fuel injection flush tools herein disclosed, the fuel injectors can be cleaned in a short time and with reduced cost. To this end, the technician need not shut down the engine or turn off the vehicle's fuel pump during the cleaning process. Moreover, the mechanic need not look up or guess the fuel pump pressure at which the cleaner should be delivered to the fuel injectors.

According to one preferred embodiment, the flush tool is connected between the engine and the gas tank or the fuel pump of the vehicle being serviced. A cleaning fluid inlet line and a fuel injector supply line are connected in series from the flush canister to the fuel injectors to be cleaned. A cleaning fluid flow control valve is located in the cleaning fluid inlet line to control the flow of cleaning fluid from the flush canister to the fuel injectors. A fuel inlet line is connected from the fuel pump or the gas tank of the vehicle to the intersection of the series connected cleaning fluid inlet line and fuel injector supply line. A fuel flow control valve is located in the fuel inlet line to control the flow of fuel to the fuel injector supply line. A first pressure gauge monitors the pressure of (e.g., shop) air being supplied to the fuel injection flush canister to pressurize the liquid cleaner therein. A second pressure gauge is connected in the fuel inlet line to monitor the fuel pump pressure.

Prior to initiating the cleaning process, the engine of the vehicle being serviced is initially not running and each of the cleaning fluid and fuel flow control valves are closed in order to block the flow of cleaning fluid and fuel through the cleaning fluid inlet line and the fuel inlet line. With the engine turned on, the fuel flow control valve is opened to permit the flow of fuel from the fuel pump or the gas tank to the fuel injectors by way of the fuel inlet line and the fuel injector supply line ahead of the still-closed cleaning fluid flow control valve located in the cleaning solution inlet line. The second pressure gauge from the fuel inlet line indicates the operating pressure of the fuel pump with the engine at idle. The first pressure gauge indicates the pressure of the air supplied to the flush canister which is adjusted to match the operating pressure of the fuel pump.

The fuel injector cleaning (i.e., decarbonization) process is initiated by once again closing the fuel flow control valve to block the flow of fuel through the fuel inlet line. The cleaning fluid flow control valve in the cleaning fluid inlet line is now opened to establish a flow path for the liquid cleaner from the fuel injection flush canister to the fuel injectors via the series connected cleaning fluid inlet line and the fuel injector supply line. Thus, combustible fuel injection cleaner is delivered under pressure (corresponding to the operating pressure of the fuel pump originally measured by the second pressure gauge) to the fuel injectors, whereby carbon deposits will be burned away.

For servicing certain vehicles, an auxiliary fuel return line can be connected from the gas tank of the vehicle to the fuel inlet line behind the fuel flow control valve. The fuel return line is temporarily disconnected from a normally closed pressure regulator valve that commonly communicates with the fuel rail of such vehicles for connection to the fuel inlet line during the fuel injection cleaning process.

DESCRIPTION OF THE PREFERRED EMBODIMENT

Figure 1:
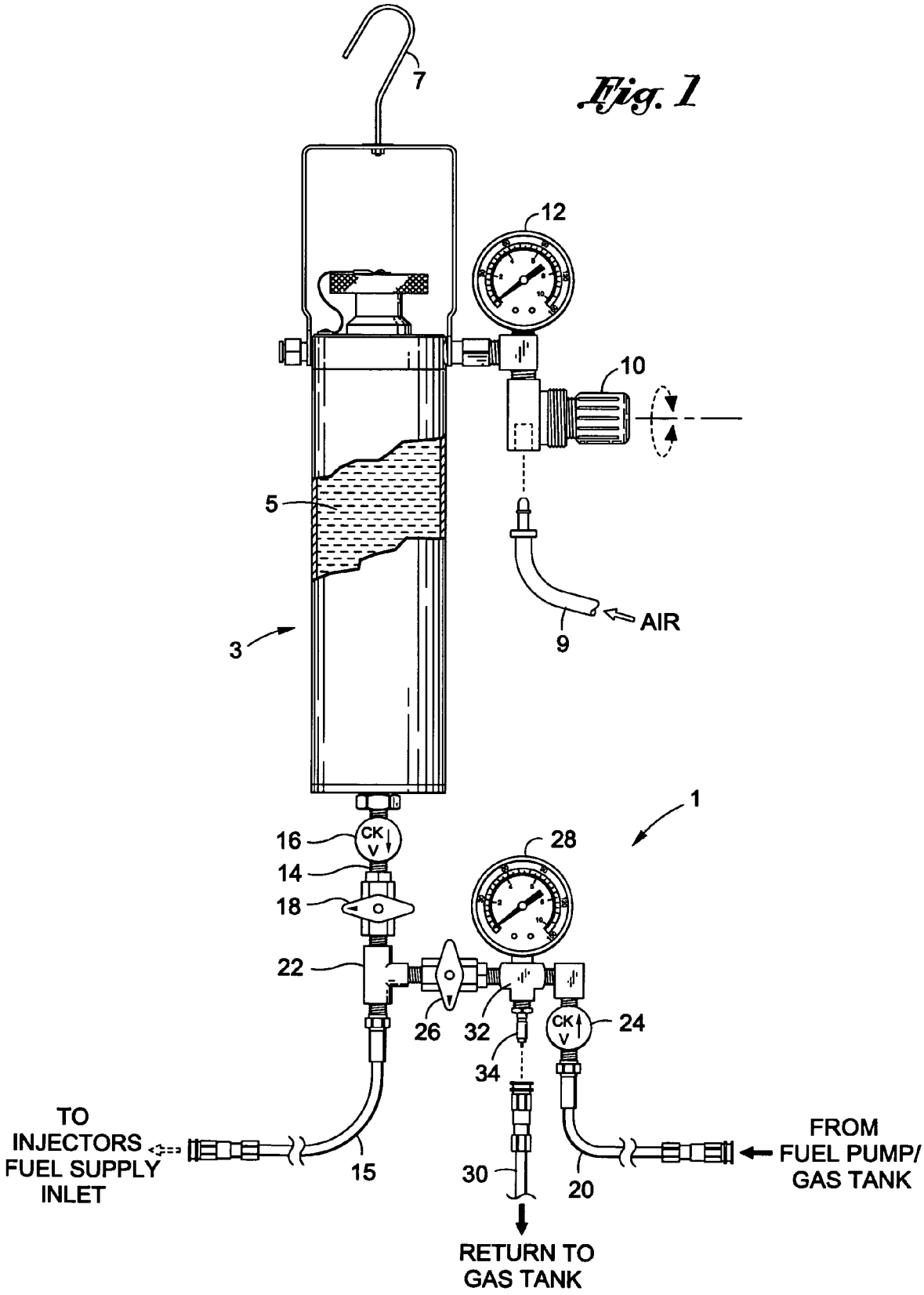
FIG. 1 shows a fuel injection flush tool according to a first preferred embodiment of this invention detachably connected to a conventional fuel injection flush canister prior to the process of cleaning (i.e., decarbonizing) the fuel injectors and related parts of a gasoline engine of a motor vehicle.

FIG. 1 of the drawings shows a fuel injection flush tool 1 according to a first preferred embodiment of this invention for cleaning the fuel injectors and related parts of a gasoline engine of a motor vehicle. The tool is shown connected to a conventional fuel injection flush canister 3 of the kind having a supply of combustible liquid fuel injection cleaner 5 to be delivered to the fuel injectors. A hook 7 extends from the top of the flush canister 3 to enable the canister to be hung at a work area. Shop air, under pressure, is supplied to the flush canister 3 via an air hose 9 to enable the cleaner 5 to be expulsed from the canister under pressure. An air pressure regulator 10 is selectively adjusted (i.e., rotated) to set the pressure of the air flowing through the air hose 9 to the flush canister 3 depending upon the operating pressure of the fuel pump of the motor vehicle being serviced. A pressure gauge 12 communicates with the air hose 9 to indicate the pressure of the air flowing therethrough to flush canister 3.

The fuel injection flush tool 1 is installed by first disconnecting the fuel lines of the engine of the motor vehicle being serviced and then locating tool 1 between the engine and the gas tank or the fuel pump. The flush tool 1 is shown in FIG. 1 connected to the fuel injection flush canister 3 when the engine is not running prior to the start of the cleaning process. A cleaning fluid inlet line 14 runs from the flush canister 3 to the fuel injectors to be cleaned (best shown in FIG. 2) by way of a fuel injector supply line 15 that is connected in series with the cleaning fluid inlet line 14. A check valve 16 is located in the cleaning fluid inlet line 14 to prevent the back flow of cleaning solution and fuel to the flush canister 3. A cleaning fluid flow control (e.g., ball) valve 18 is also located in the cleaning fluid inlet line 14 to open and close the flush canister 3. In the case of FIG. 1, prior to commencement of the fuel injector cleaning process when the engine is turned off, the cleaning fluid flow control valve 18 is moved (i.e., rotated) to a closed position to block the flow of cleaner 5 from the canister 3 to the engine.

A fuel inlet line 20 is connected to the intersection of the series connected cleaning fluid inlet line 14 and the fuel injector supply line 15 at a T-coupler 22 located ahead of the control valve 18. The fuel inlet line 20 supplies fuel from the fuel pump or gas tank of the vehicle being serviced to the fuel injectors. A check valve 24 is located in the fuel inlet line 20 to prevent the back flow of cleaning solution and fuel to the fuel pump or gas tank. A fuel flow control (e.g., ball) valve 26 is also located in fuel inlet line 20 to control the flow of fuel to the fuel injectors. In the case of FIG. 1, prior to commencement of the fuel injector cleaning process when the engine is turned off, the fuel flow control valve 26 is moved (i.e., rotated) to a closed position to block the flow of fuel from the fuel pump or gas tank to the engine.

A pressure gauge 28 communicates with the fuel inlet line 20 to monitor the operating pressure of the fuel pump of the engine. Prior to commencement of the fuel injector cleaning process when the engine of the vehicle being serviced is turned off, the corresponding fuel pump operating pressure indicated by pressure gauge 28 will be 0. The air pressure indicated by the pressure gauge 12 that communicates with the air hose 9 is set by the technician to match the pressure indicated by the pressure gauge 28. In this case, the air pressure regulator 10 is adjusted so that no air flows to the flush canister 3 by way of air hose 9.

An auxiliary quick-connect fuel return line 30 is shown detachably connected to the fuel inlet line 20 at a 4-way block 32 located behind the fuel flow control valve 26. Such a fuel return line 30, by which to return fuel flowing through the fuel inlet line 20 to the fuel pump or gas tank, is typically not required in most newer vehicles. The fuel return line 30 is coupled to the 4-way block 32 at a normally closed pressure responsive valve 34. The application of the fuel return line 30 will be explained in greater detail when referring to FIG. 4.

Figure 2:
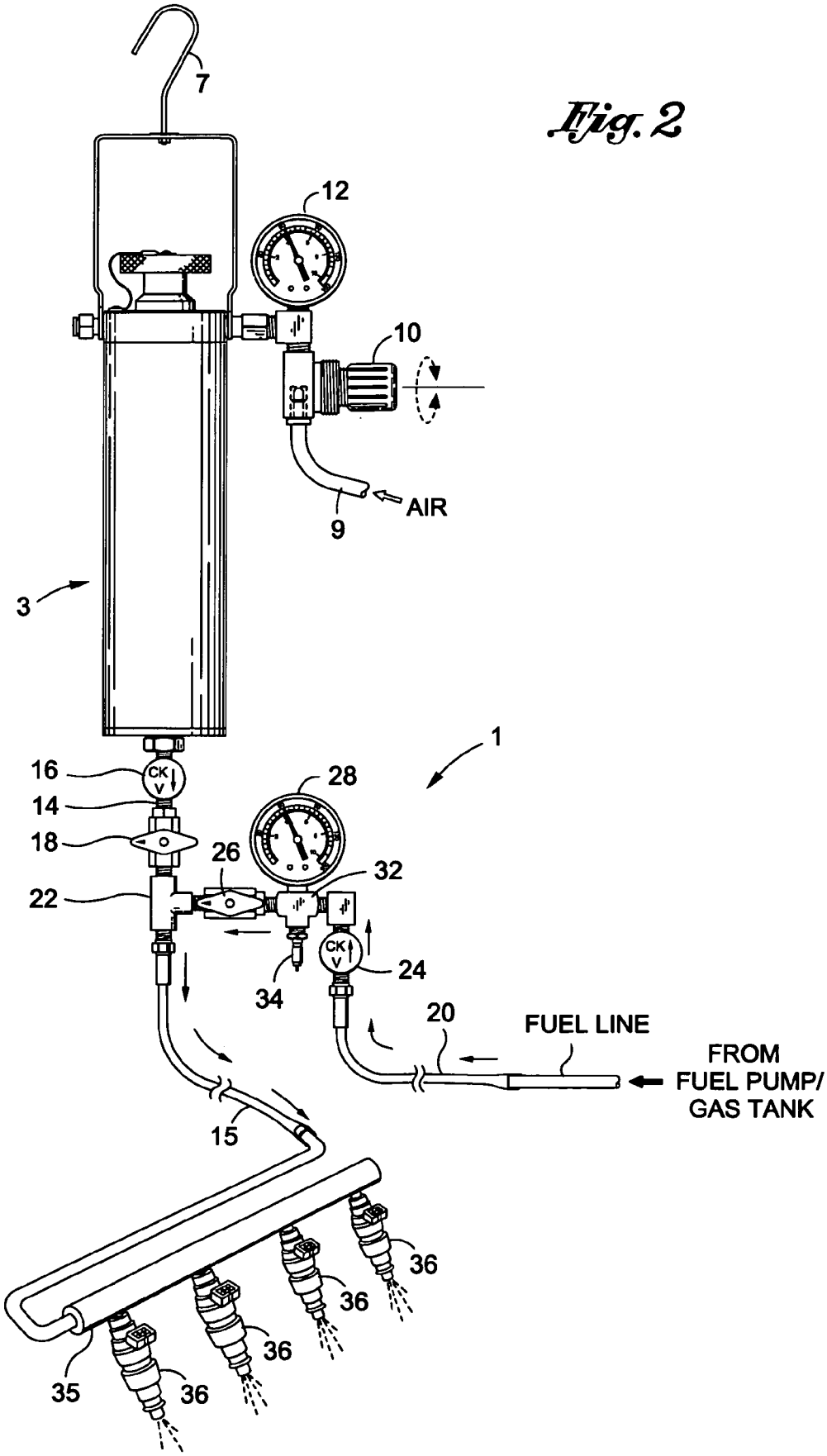
FIG. 2 shows the fuel injection flush tool of FIG. 1 prior to the cleaning process with fuel flowing therethrough to the fuel injectors to be cleaned.

FIG. 2 of the drawings shows the fuel injection flush tool 1 still prior to commencement of the fuel injector cleaning process. However, in this case, the gasoline engine of the vehicle being serviced is now running and idling. The cleaning fluid flow control valve 18 located in the cleaning fluid inlet line 14 remains closed to continue blocking the flow of the liquid cleaner 5 from the flush canister 3 to the fuel injectors. So that the engine may be provided with the fuel needed to operate, the fuel flow control valve 26 located in the fuel inlet line 20 is now opened to complete a fuel path between the fuel pump or gas tank and the fuel rail 35 of the fuel injectors 36 by way of the fuel inlet line 20 and the fluid injector supply line 15 that is connected to the cleaning fluid inlet line 14 at the T-coupler 22. In the example shown in FIG. 2, the fuel injectors 36 are those found in a 4-cylinder engine.

Once the engine of the vehicle being serviced is running, the pressure gauge 28 that communicates with the fuel inlet line 20 will indicate the operating pressure of the fuel pump. The flush canister 3 is pressurized by shop air being supplied thereto via the air hose 9. The technician adjusts the air pressure regulator 10 until the air pressure indicated by the pressure gauge 12 which communicates with the air hose 9 matches the engine operating fuel pump pressure indicated by pressure gauge 28. By virtue of the foregoing, the technician does not have to perform a table look-up or guess the pressure at which the air is supplied to the flush canister 3 to pressurize the fuel injection cleaner therein during the fuel injector cleaning process as will now be described.

Figure 3:
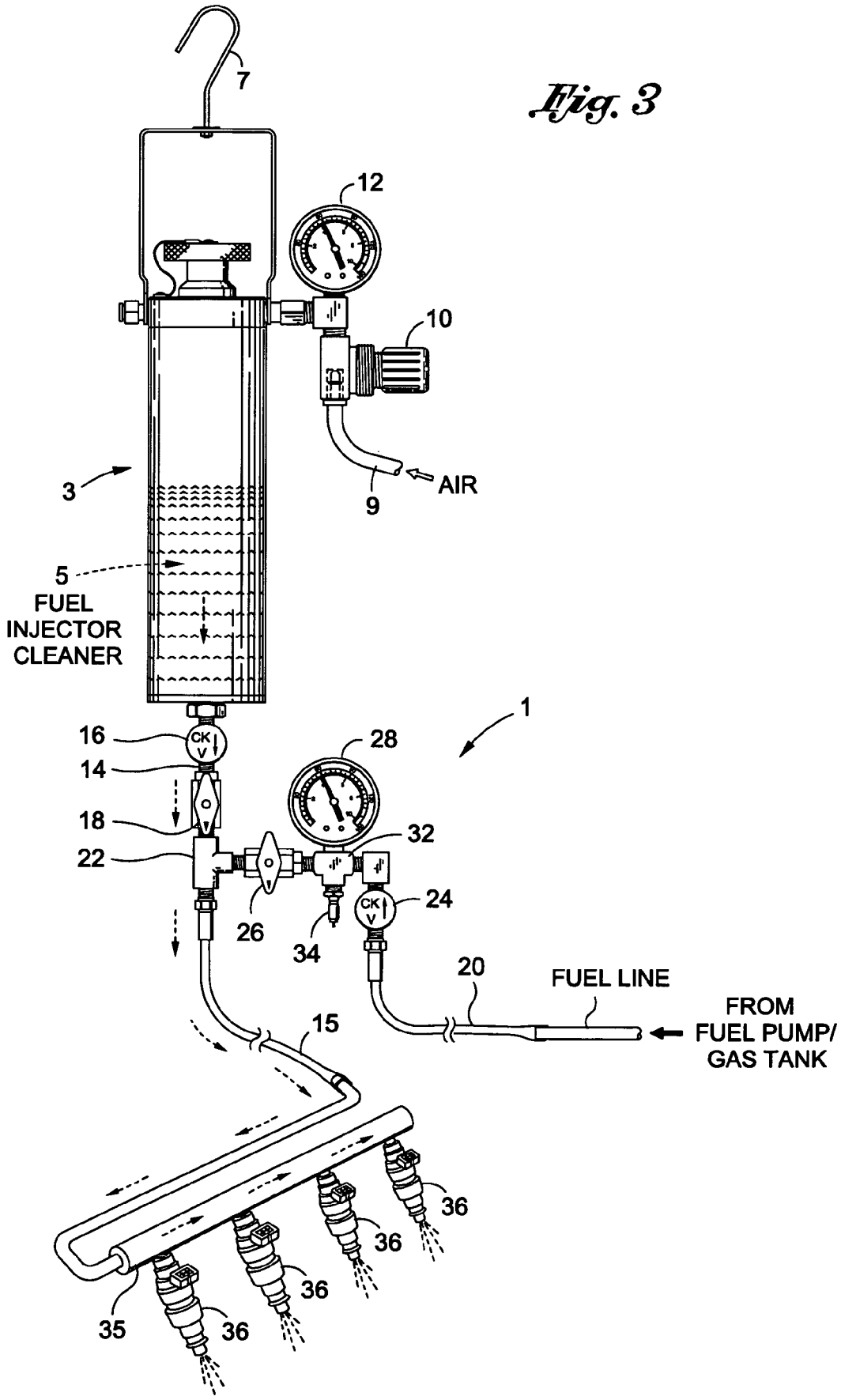
FIG. 3 shows the fuel injection flush tool of FIG. 1 during the cleaning process with a liquid cleaner flowing therethrough between the flush canister and the fuel injectors.

FIG. 3 of the drawings shows the fuel injection flush tool 1 during the fuel injector cleaning (i.e., decarbonization) process. In this case, the fuel flow control valve 26 located in the fuel inlet line 20 is returned to its closed position to block the flow of fuel from the fuel pump or gas tank to the fuel injectors 36 of the gasoline engine being serviced. However, the cleaning fluid flow control valve 18 located in the cleaning fluid inlet line 14 is now moved (i.e., rotated) to the open position to establish a flow path for the liquid cleaner 5 from canister 3 to the fuel injectors 36 via the series connected cleaning fluid inlet line 14 and the fuel injector supply line 15. That is, the fuel injector cleaner 5 is expulsed under pressure (corresponding to the operating pressure of the fuel pump) from the fuel injection flush canister 3 by the air being supplied to the canister via air hose 9. The cleaning fluid flows through the cleaning fluid inlet line 14 and the fuel injector supply line 15 to the fuel rail 35 for distribution to the fuel injectors 36, whereby carbon deposits will be burned away.

It may be appreciated that with the fuel control valve 26 closed, the engine of the vehicle will run off the cleaning solution being supplied by cleaning fluid inlet line 14 and the fuel injector supply line 15 rather than the fuel flowing through fuel inlet line 20 and the fuel injector supply line 15. The engine operating pressure and the air pressure indicated by pressure gauges 28 and 12 remains unchanged from those shown in FIG. 2 prior to the cleaning process. The engine will continue to run until all of the fuel injection cleaner (about 11.5 ounces) within the flush canister 3 has been consumed, at which time the engine will automatically stall and the fuel pump will shut off.

It may also be appreciated that the engine need not be turned off and the fuel pump need not be disabled during the cleaning process. With the fuel flow control valve 26 closed and the fuel inlet line 20 blocked, pressure will build up in the fuel pump, whereby the fuel pump will be internally bypassed such that fuel is automatically returned to the gas tank.

Figure 4:
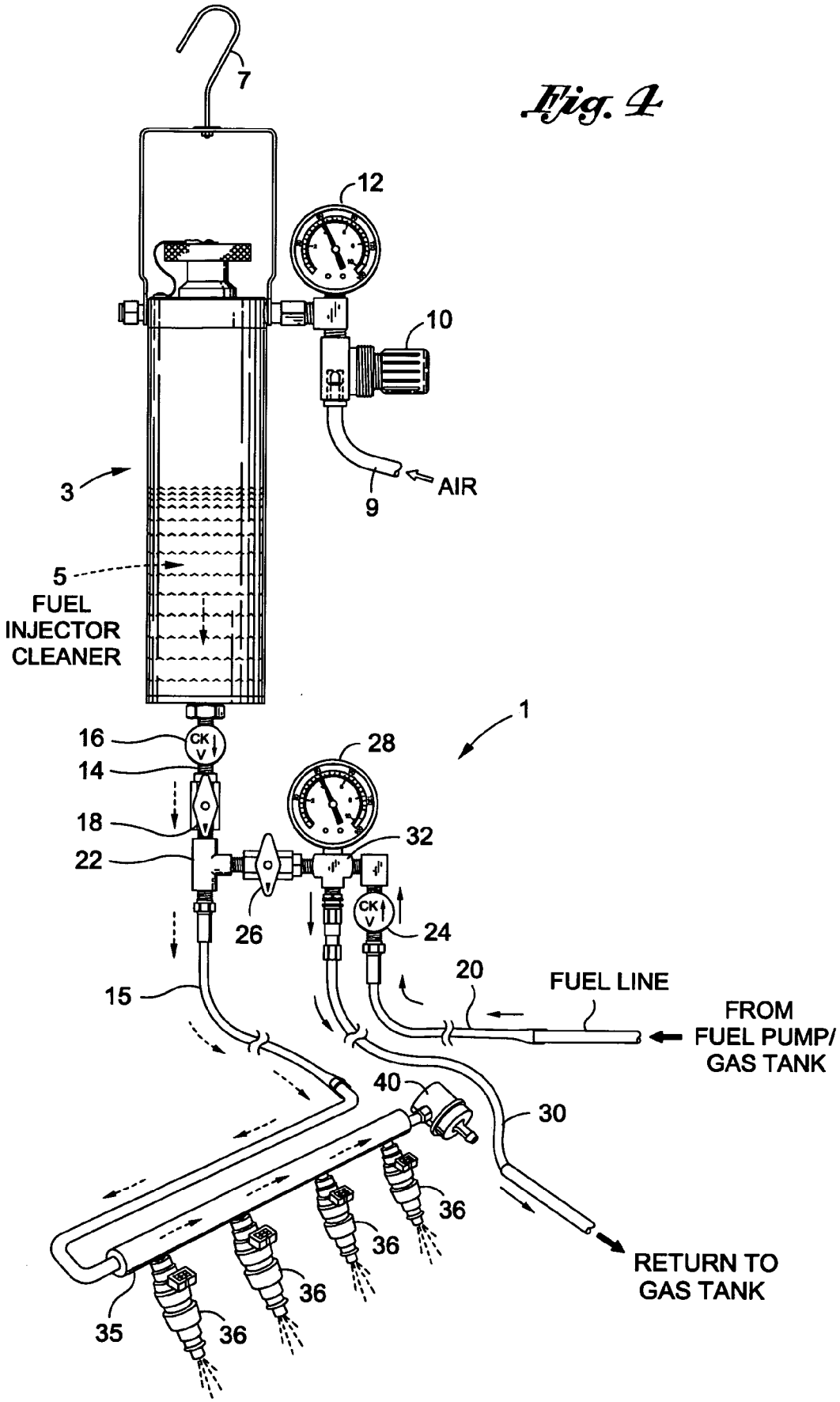
FIG. 4 shows the fuel injection flush tool of FIG. 1 during the fuel injector cleaning process including an auxiliary quick-connect fuel return line to return fuel to the fuel tank of the vehicle.

As was explained while referring to FIG. 1, an auxiliary fuel return line 30 may need to be connected to the fuel inlet line 20 of the fuel injection flush tool 1 when certain older motor vehicles are being serviced. Referring in this regard to FIG. 4 of the drawings, such a fuel return line 30 is shown detachably connected from the pressure responsive valve (designated 34 in FIG. 3) at the 4-way block 32 of the fuel inlet line 20 to the gas tank of the vehicle. As will be known to those skilled in the art, the fuel inlet line 20 of the older vehicles identified above is commonly connected to a normally closed fuel pressure regulator valve 40 that communicates with the fuel rail 35 and opens to release fuel back to the fuel tank in the event fuel pressure exceeds a maximum operating pressure. In the example of FIG. 4, the fuel return line 30 has been temporarily disconnected from the pressure regulator valve 40 and connected to the fuel inlet line 20 at the 4-way block 32 during the cleaning process.

In this case, the cleaning fluid flow control valve 18 is opened prior to starting the engine for cleaning. It has been found that when return line 30 is used, the air pressure applied to the flush canister 12 may have to be reduced by about 10 psi to avoid leakage at regulator valve 40. The fuel flow control valve 26 remains closed so that the fuel inlet line 20 is blocked as described while referring to FIG. 3, and a fuel return path is established from the gas tank, through the fuel inlet line 20 behind valve 26 and the fuel return line 30, and back to the gas tank. Thus, neither the gasoline engine nor the fuel pump needs to be disabled during the cleaning process. That is, the engine will continue to run on the liquid cleaner 5 being supplied thereto via the cleaning fluid inlet line 14 and the fuel injector supply line 15. Instead of bypassing itself as in the case of FIG. 3, fuel supplied to the fuel pump is recycled back to the gas tank by way of the aforementioned fuel return path including inlet and return lines 20 and 30. At the conclusion of the cleaning process, the engine will stall and the fuel pump will shut off. The fuel return line 30 is disconnected from the 4-way block 32 of the fuel inlet line 20 and reconnected to the pressure regulator valve 40 at the fuel rail 35.

Figure 5:
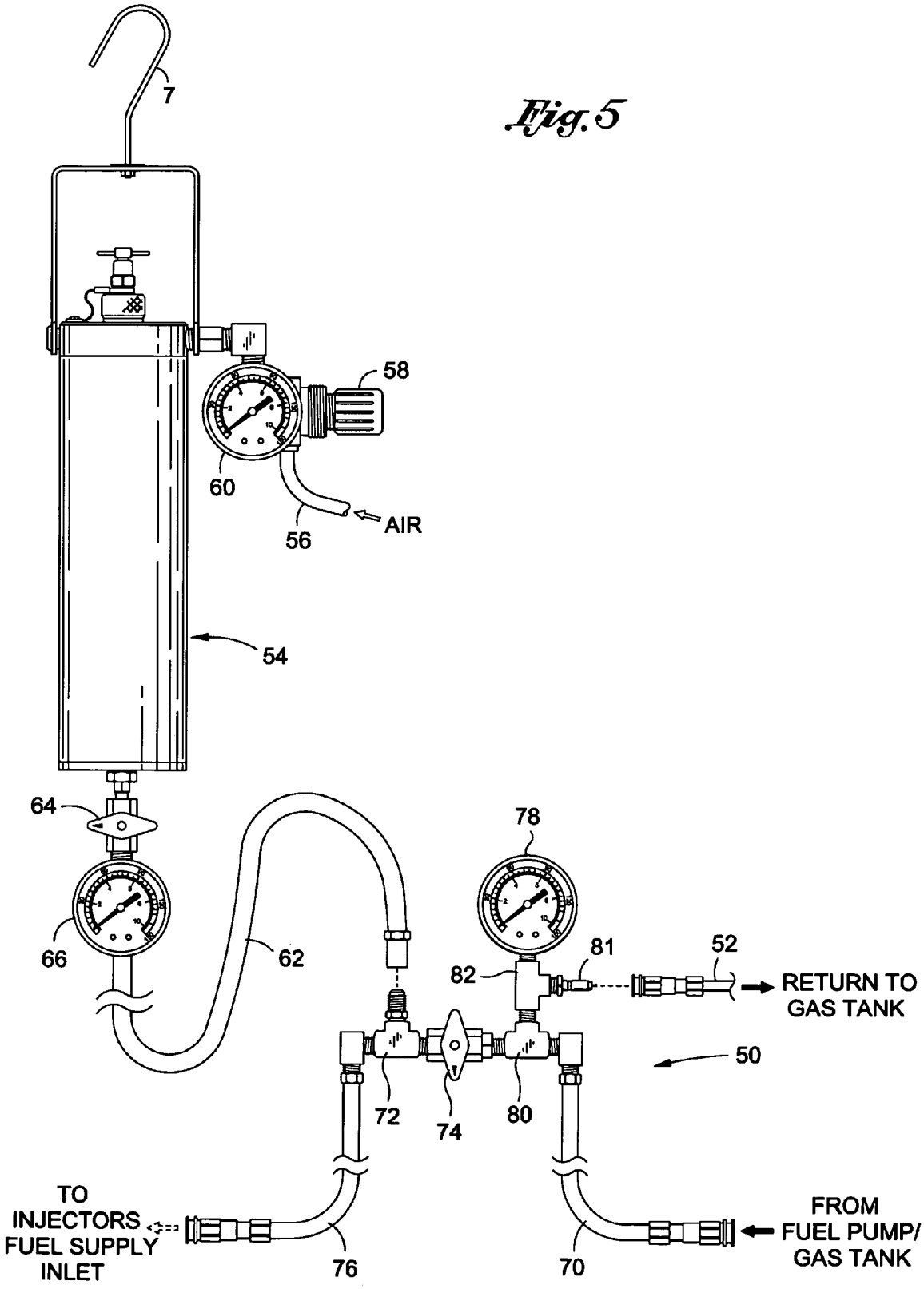
FIG. 5 shows a fuel injection flush tool according to another preferred embodiment of this invention to be detachably connected to the conventional fuel injection flush canister of FIG. 1 for cleaning the fuel injectors of a gasoline engine.

FIG. 5 of the drawings shows a modified fuel injection flush tool 50 to be used with a fuel return line 52 (such as that designated 30 and previously described while referring to FIG. 4) commonly associated with certain older motor vehicles. Like the fuel injection flush tool 1 of FIGS. 1-4, the flush tool 50 of FIG. 5 is detachably connected to a conventional fuel injection flush canister 54 containing a supply of combustible liquid fuel injection cleaner to be delivered to the fuel injectors of the gasoline engine being serviced to remove carbon deposits therefrom. As in the case of the flush canister 3 previously described, the canister 54 includes an air hose 56 to supply shop air, under pressure, an air pressure regulator 58 to control the pressure of the air being supplied to canister 54 via air hose 56, and a pressure gauge 60 that communicates with the air hose 56 to measure the pressure of the air supply. A cleaning fluid inlet line 62 carries fuel injector cleaner from the flush canister 54 to the fuel injection flush tool 50 for delivery to the fuel injectors when a cleaning fluid flow control (e.g., ball) valve 64 which is located in the cleaning fluid inlet line 62 is rotated from the closed position (as shown) to an open position. An optional pressure gauge 66 is connected in the inlet line 62 to measure the pressure of the cleaner flowing therethrough.

A fuel inlet line 70 is connected between the fuel pump or the gas tank of the vehicle being serviced and a 3-way block 72. A normally closed fuel flow control (e.g., ball) valve 74 is located in the fuel inlet line 70 to control the flow of fuel therethrough. The cleaning fluid inlet line 62 is detachably connected to the 3-way block 72. A fuel injector supply line 76 is connected from the 3-way block 72 to the fuel injectors to be cleaned. A pressure gauge 78 communicates with the fuel inlet line 70 at a 3-way block 80 by way of a T-coupler 82 so as to measure the operating pressure of the fuel pump of the engine during idling. In this regard, and as previously explained, the air pressure delivered to the fuel injection flush canister 54 through air hose 56 (measured by pressure gauge 60) is adjusted at pressure regulator 58 to match the engine operating fuel pump pressure measured by pressure gauge 78. The fuel return line 52 is also connected to the 3-way block 80 by way of a normally closed pressure responsive valve 81 and the T-coupler 82.

The use and operation of the fuel injection flush tool 50 of FIG. 5 for servicing the aforementioned older cars is identical to the flush tool 1 shown in FIG. 4. Thus, prior to initiating the cleaning operation (with the cleaning fluid flow control valve 64 remaining closed and the fuel flow control valve 74 opened), a fuel path is established from the gas tank, through the fuel inlet line 70 and the fuel injector supply line 76, and to the fuel injectors to be cleaned. During the cleaning process, the fuel flow control valve 74 is closed and the cleaning fluid flow control valve 64 is opened at the same time. Liquid cleaner now flows under pressure from the fuel injection flush canister 54 to the fuel injectors through the cleaning fluid inlet line 62 and the fuel injector supply line 76 so that the engine will run off the liquid cleaner. With the fuel flow control valve 74 closed and the fuel inlet line 70 blocked, the pressure responsive valve 81 will open, and fuel from the fuel pump or gas tank will be returned to the tank via the fuel return line 52 so that the engine need not be turned off and the fuel pump need not be disabled during cleaning.

Figure 6:
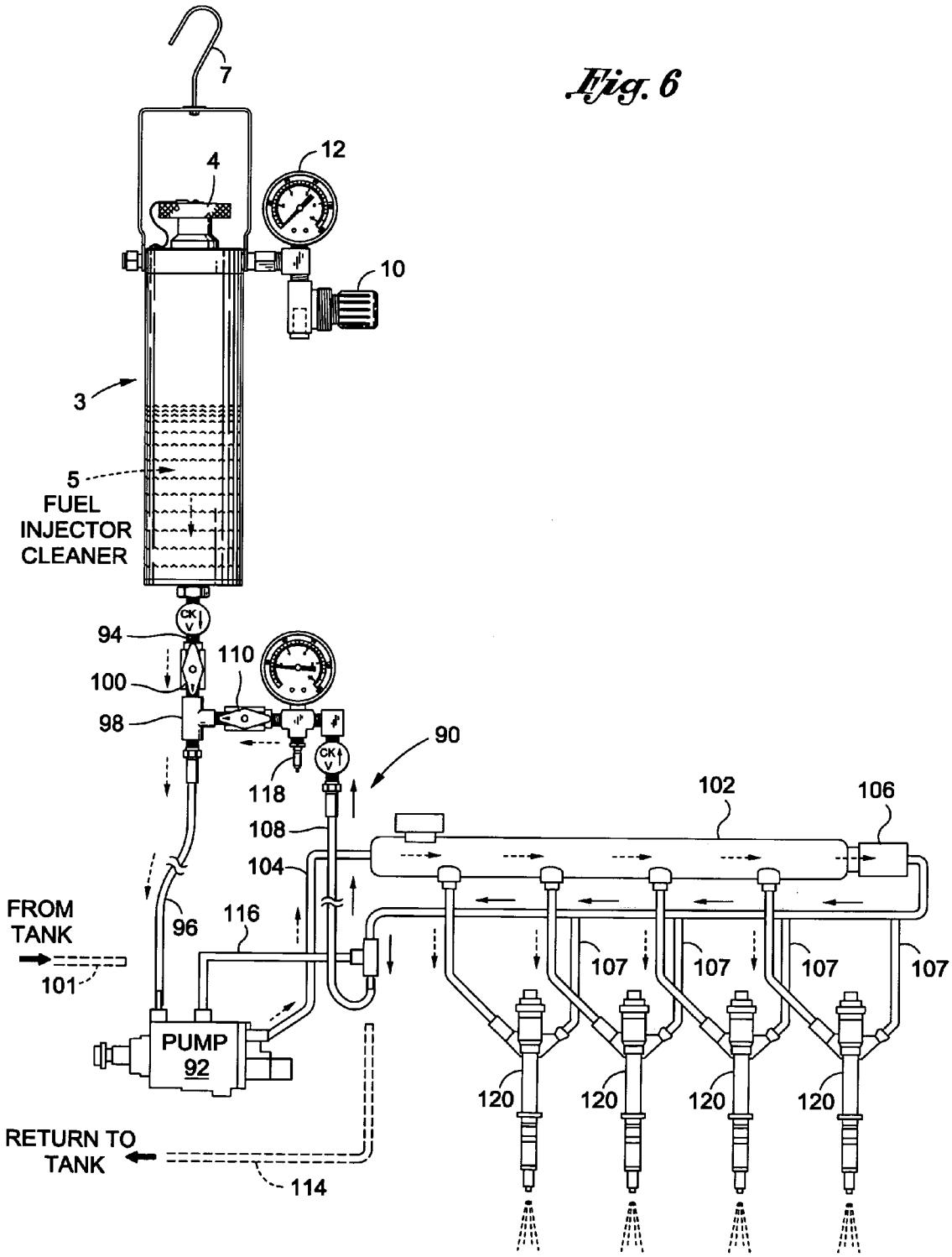
FIG. 6 shows a fuel injection flush tool according to yet another preferred embodiment connected to the conventional fuel injection flush canister of FIG. 1 during the process of cleaning the fuel injectors and related parts of a diesel engine of a motor vehicle with a diesel injection pump or with a common rail system.

FIGS. 1-5 of the drawings show fuel injection flush tools 1 and 50 having particular application for removing carbon deposits and cleaning the fuel injectors and related pats of an engine that runs on gasoline. FIG. 6 of the drawings shows a fuel injection flush tool 90 to remove carbon deposits from a diesel engine. As with the previously described fuel injection flush tools 1 and 50, the tool 90 shown in FIG. 6 is connected to a conventional fuel injection flush canister 3 having a supply of combustible liquid fuel injection cleaner 5 to be delivered to the fuel injectors 120 of the diesel engine. Because the liquid cleaner 5 will be continuously recycled back to the high pressure diesel fuel injection pump 92 (as will soon be explained), the requirement to pressurize the cleaner by applying shop air to the flush canister 3 is eliminated. Therefore, in most cases, no air hose (designated 9 and 56 in FIGS. 1-5) need be connected to canister 3. In this case, when the cleaning process commences, the canister 3 is opened (at an air inlet valve 4 thereof) so that the liquid cleaner 3 will simply flow therefrom to the fuel injection flush tool 90 under the influence of gravity. However, for a common rail fuel system, an air hose (not shown) may be required to apply air pressure to the canister 3 to cause the cleaner to be expulsed therefrom.

The fuel injection flush tool 90 includes a cleaning fluid inlet line 94 that is connected in series with a diesel pump inlet line 96 at a T-coupler 98. The series connected inlet lines 94 and 96 are connected between the flush canister 3 and the diesel fuel injection pump 92. A cleaning fluid flow control (e.g., ball) valve 100 is located in the cleaning fluid inlet line 94. Prior to commencing the cleaning operation, the flow control valve 100 is closed to block the flow of liquid cleaning from the flush canister 3 to the fuel injection pump 92. Also prior to the cleaning operation, the series connected cleaning fluid and diesel pump inlet lines 94 and 96 are disconnected from the fuel injection pump 92, and the pump is connected to the fuel tank (via a line 101) of the vehicle.

The fuel injection pump 92 is connected to the fuel rail 102 of the diesel engine being serviced by a diesel pump outlet line 104. An excess fuel/liquid cleaner collector 106 at the outlet of the fuel rail 102 is connected by way of a fuel inlet line 108 to the T-coupler 98 at the intersection of the series connected cleaning fluid and diesel pump inlet lines 94 and 96. Fuel injector lines 107 run from the fuel rail 102 to the fuel injectors 120 and from the fuel injectors to the fuel inlet line 108. A fuel flow control (e.g., ball) valve 110 is located in the fuel inlet line 108. Prior to connecting the fuel injection flush tool 90 between the flush canister 3 and the fuel pump 92 as shown, a fuel return line 114 is connected between the fuel rail 102 and the fuel tank of the vehicle.

The fuel injectors 120 to be cleaned (i.e., decarbonized) lie in fluid communication with the fuel rail 102 by way of the fuel injector lines 107 to receive either diesel fuel from the fuel pump 92 during normal vehicle operation when no cleaning is performed or cleaning fluid from the flush canister 3 via the pump 92 when the fuel injectors are being cleaned. In the example of FIG. 6, the fuel injectors 120 are found in a 4-cylinder diesel engine.

During the operation of cleaning the fuel injectors 120, the cleaning fluid flow control valve 100 in the cleaning fluid inlet line 94 and the fuel flow control valve 110 in the fuel inlet line 108 are both moved to the open position. The air inlet valve 4 of the fuel injection flush canister 3 is opened so that liquid cleaner 5 from the flush canister will flow to the fuel injection flush tool 90. Accordingly, the liquid cleaner 5 will now pass through a continuous flow path including the cleaning fluid inlet line 94, the diesel pump inlet line 96, the high pressure fuel injection pump 92, and the diesel pump outlet line 104 to the fuel rail 102. The liquid cleaner 5 is supplied to the fuel injectors 120 from the fuel rail 102 via the fuel injector lines 107 where it will combust and burn away carbon deposits.

Excess liquid cleaner 5 that is not combusted by the fuel injectors 120 is pumped along the aforementioned continuous flow path from the liquid cleaner collector 106 of fuel rail 102 and the fuel injector lines 107, through the fuel inlet line 108, and back to the diesel pump inlet line 96 at the T-coupler 98. Thus, it may be appreciated that the liquid cleaner is continuously recycled through the fuel injection flush tool 90 with the fuel pump 92 continuing to operate while the fuel injectors 120 are being cleaned so as to avoid an early consumption of the cleaner and provide for a reliable cleaning of the fuel injectors of the diesel engine being serviced.

As an option, the diesel fuel injection pump 92 can be connected to the fuel inlet line 108 by means of connecting the pump return line 116 to a pressure responsive valve 118 that communicates with inlet line 108.

The invention claimed is:

1. A method for cleaning the fuel injectors of a motor vehicle which has a fuel tank to remove carbon deposits from the engine thereof, wherein said engine has a fuel pump to pump fuel from the fuel tank and fuel injectors to receive fuel pumped by the fuel pump, said method comprising the steps of:

supplying fuel to the fuel injectors to be cleaned while the engine of the motor vehicle and the fuel pump are running, wherein the fuel is supplied by a fuel inlet line that channels fuel from the fuel pump towards the fuel injectors, and wherein the fuel inlet line comprises a fuel valve that is between the fuel pump and the fuel injectors and that is open while fuel is being supplied to the fuel injectors;

measuring the pressure of the fuel pump of the engine at which the fuel is supplied to the fuel injectors to be cleaned while the engine and the fuel pump are running;

blocking the flow of fuel to the fuel injectors to be cleaned while the engine and the fuel pump are running, wherein the blocking is performed by closing the fuel valve; and delivering a liquid fuel injection cleaner from a source of said cleaner to the fuel injectors to be cleaned while the engine and the fuel pump are still running and at a pressure which is the same as the fuel pump pressure that was measured when fuel was being supplied to the fuel injectors so that the engine runs on the liquid cleaner.

2. The method in claim 1, including the additional steps of connecting the fuel inlet line between the fuel pump of the motor vehicle and a coupler; connecting a fuel injector supply line between said coupler and the fuel injectors to be cleaned; and providing fuel to the fuel injectors by way of said fuel inlet line and said fuel injector supply line during the step of supplying fuel to the fuel injectors to be cleaned.

3. The method recited in claim 2, including the additional step of measuring the fuel pump pressure at which fuel is provided to the fuel injectors to be cleaned by means of a pressure gauge communicating with said fuel inlet line.

4. The method recited in claim 3, including the additional steps of providing air to the source of liquid fuel injection cleaner to cause the cleaner to be delivered from said source to the fuel injectors to be cleaned at the fuel pump pressure measured by the pressure gauge communicating with said fuel inlet line.

5. The method recited in claim 2, including the additional step of connecting a liquid cleaner inlet line between the source of liquid fuel injection cleaner and said coupler so that the liquid fuel injection cleaner flows through said liquid cleaner inlet line and said fuel injector supply line during the step of delivering a liquid fuel injection cleaner to the fuel injectors to be cleaned.

6. The method recited in claim 5, including the additional steps of locating a valve in said liquid cleaner inlet line; closing said valve during the step of supplying fuel to the fuel injectors to be cleaned so as to block the flow of the cleaner through said liquid cleaner inlet line; and opening said valve during the step of delivering a liquid fuel injection cleaner to the fuel injectors to be cleaned so that the cleaner flows through said liquid cleaner inlet line.

7. The method recited in claim 1, including the additional step of connecting a fuel return line between said fuel inlet line and the fuel tank of the motor vehicle for returning fuel within said fuel return line to the tank when the fuel valve of said fuel inlet line is closed and the flow of fuel through said fuel inlet line to the fuel injectors is blocked.

8. The method of claim 7, including the additional step of locating a normally closed pressure responsive valve in said fuel return line, said pressure responsive valve adapted to open when the fuel valve of said fuel inlet line is closed and the flow of fuel through said fuel inlet line to the fuel injectors is blocked.

9. A method for cleaning the fuel injectors of a motor vehicle which has a fuel tank to remove carbon deposits from the engine thereof, wherein said engine has a fuel pump to pump fuel from the fuel tank and fuel injectors to receive fuel pumped by the fuel pump, said method comprising the steps of:

connecting a fuel inlet line between one of the fuel tank or the fuel pump and the fuel injectors to be cleaned and supplying the fuel to the fuel injectors by way of said fuel inlet line while the engine of the motor vehicle is running;

measuring the pressure of the fuel pump of the engine at which the fuel is supplied to the fuel injectors to be cleaned while the engine is running;

blocking the flow of fuel to the fuel injectors to be cleaned while the engine is running;

delivering a liquid fuel injection cleaner from a source of said cleaner to the fuel injectors to be cleaned at a pressure which is the same as the fuel pump pressure that was measured when fuel was being supplied to the fuel injectors so that the engine runs on the liquid cleaner;

locating a valve in said fuel inlet line, opening said valve during the step of supplying fuel to the fuel injectors to be cleaned so that fuel flows through said fuel inlet line from the one of the fuel tank or the fuel pump of the motor vehicle, and closing said valve during the step of blocking the flow of fuel to the fuel injectors to be cleaned so as to stop the flow of fuel through said fuel inlet line; and connecting a fuel return line between said fuel inlet line and the fuel tank of the motor vehicle for returning fuel within said fuel return line to the tank when the valve located in said fuel inlet line is closed and the flow of fuel through said fuel inlet line to the fuel injectors is blocked.

10. The method recited in claim 9, including the additional steps of connecting a pressure gauge in said fuel inlet line and measuring the fuel pump pressure at which fuel is provided to the fuel injectors to be cleaned by means of said pressure gauge.

11. A method for cleaning the fuel injectors of a motor vehicle which has a fuel tank to remove carbon deposits from the engine thereof, wherein said engine has a fuel pump to pump fuel from the fuel tank and fuel injectors to receive fuel pumped by the fuel pump, said method comprising the steps of:

connecting a fuel inlet line between the fuel pump and the fuel injectors to be cleaned;

pumping the fuel to the fuel injectors to be cleaned by way of said fuel inlet line while the engine is running;

connecting a pressure gauge in said fuel line and measuring the pressure of the fuel pump at which fuel is pumped to the fuel injectors while the engine is running;

connecting a fuel control valve in the fuel inlet line between the fuel pump and the fuel injectors and closing said fuel control valve for blocking the flow of fuel to the fuel injectors by way of said fuel inlet line while the engine is running and without having to shut off the fuel pump; and delivering a liquid fuel injection cleaner from a source of said cleaner to the fuel injectors to be cleaned while the engine and the fuel pump are still running and at a pressure which is the same as the fuel pump pressure that was measured by said pressure gauge when fuel was being pumped to the fuel injectors so that the engine runs on the liquid cleaner.

12. The method recited in claim 11, including the additional steps of connecting a couple to said fuel inlet line; connecting a fuel injector supply lire between said coupler and the fuel injectors to be cleaned; providing fuel to the fuel injectors by way of said fuel inlet line and said fuel injector supply line during the step of pumping fuel to the fuel injectors to be cleaned; and connect a liquid cleaner inlet line between the source of liquid fuel cleaner and said coupler so that the liquid fuel injection cleaner flows through said liquid cleaner inlet line and said fuel injector supply line during the step of delivering a liquid fuel injection cleaner to the fuel injectors to be cleaned.

13. The method recited in claim 12, including the additional steps of locating a cleaning fluid control valve in said liquid cleaner inlet line; closing said cleaning fluid control valve during the step of supplying fuel to the fuel injectors to be cleaned so as to block the flow of the cleaner through said liquid cleaner inlet line; and opening said cleaning fluid control valve during the step of delivering a liquid fuel injection cleaner to the fuel injectors to be cleaned so that the cleaner flows through said liquid cleaner inlet line.

* * * * *